US007798582B2

(12) United States Patent
Yu et al.

(10) Patent No.: US 7,798,582 B2
(45) Date of Patent: Sep. 21, 2010

(54) FIXING APPARATUS FOR SLIDE RAIL

(75) Inventors: Mo-Ming Yu, Shenzhen (CN); Hai-Chen Zhou, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 231 days.

(21) Appl. No.: 12/205,138

(22) Filed: Sep. 5, 2008

(65) Prior Publication Data

US 2009/0261699 A1 Oct. 22, 2009

(30) Foreign Application Priority Data

Apr. 16, 2008 (CN) ..... 2008 1 0301153

(51) Int. Cl.
*A47B 88/00* (2006.01)

(52) U.S. Cl. ..... 312/334.4; 312/334.5; 312/333; 312/319.1; 211/26

(58) Field of Classification Search ..... 312/334.4, 312/334.5, 333, 319.1, 334.7, 334.8, 265.4; 211/26, 175, 191, 192; 248/220.41, 220.43, 248/221.11, 222.11, 222.12, 298.1; 361/724–727
See application file for complete search history.

(56) References Cited

U.S. PATENT DOCUMENTS

| | | | | |
|---|---|---|---|---|
| 5,833,337 | A * | 11/1998 | Kofstad | 312/334.4 |
| 6,230,903 | B1 * | 5/2001 | Abbott | 211/26 |
| 6,659,577 | B2 * | 12/2003 | Lauchner | 312/334.5 |
| 6,666,340 | B2 * | 12/2003 | Basinger et al. | 312/334.4 |
| 6,702,412 | B2 * | 3/2004 | Dobler et al. | 312/334.5 |
| 6,773,080 | B2 * | 8/2004 | Chen et al. | 312/334.4 |
| 6,840,388 | B2 * | 1/2005 | Mayer | 211/26 |
| 6,891,727 | B2 * | 5/2005 | Dittus et al. | 312/334.5 |
| 6,935,521 | B2 * | 8/2005 | Gundlach et al. | 211/26 |
| 6,957,878 | B2 * | 10/2005 | Greenwald et al. | 312/334.4 |
| 7,703,734 | B2 * | 4/2010 | Chen et al. | 248/298.1 |
| 2004/0217073 | A1 * | 11/2004 | Dobler et al. | 211/26 |
| 2008/0296455 | A1 * | 12/2008 | Brock et al. | 248/298.1 |

FOREIGN PATENT DOCUMENTS

| | | | | |
|---|---|---|---|---|
| DE | 3103281 | A1 * | 8/1982 | 312/334.4 |

* cited by examiner

*Primary Examiner*—Hanh V Tran
(74) *Attorney, Agent, or Firm*—Clifford O. Chi

(57) ABSTRACT

A fixing apparatus for fixing a slide rail to a first column and a second column includes a first fixing member, a release member, and a second fixing member. The slide rail includes a flange formed perpendicularly at a first end of the slide rail. The first fixing member attached to and slid along the first end of the slide rail includes a tab. The tab and the flange sandwich the first column. The release member attached to and slid along to the slide rail includes a latching hook formed at a first end to engage with the first fixing member, a mounting tab extending from the release member adjacent to a second end, and an opening adjacent to the mounting tab. The second fixing member attached to the second end of the release member includes a fixing tab. The tab and the mounting tab sandwich the second column.

16 Claims, 9 Drawing Sheets

FIXING APPARATUS FOR SLIDE RAIL

BACKGROUND

1. Field of the Invention

The present invention relates to fixing apparatuses for slide rails and, more particularly, to a fixing apparatus for readily fixing or removing a slide rail.

2. Description of Related Art

Slide rails are used in a variety of applications, including business furniture, kitchen drawers, electronic racks, and copiers.

A typical three-section slide rail assembly includes a first slide rail, a second slide rail, and a third slide rail. A ball rail is sandwiched between any two of the first slide rail, the second slide rail, and the third slide rail to provide a smooth sliding movement. Moreover, the third slide rail and the second slide rail mount a retaining member and a stop member, respectively to prevent the third slide rail from extending too far. The retaining member is attached to an inner surface of the third slide rail, and provided with an inclined wall. The stop member is mounted to a front end of the second slide rail, and provided with a protrusion. To prevent users from drawing the third slide rail out too far from the second slide rail, the protrusion of the stop member engages with the inclined wall of the retaining member.

Conventionally, in a server, the first slide rail is attached to a bracket of the server by bolts. However, attachment by bolts is tiresome and time-consuming.

Consequently, it is required to provide a fixing apparatus which allows readily secure installation or removal of a slide rail thereto or therefrom.

DETAILED DESCRIPTION OF THE EMBODIMENTS

Figure 1:
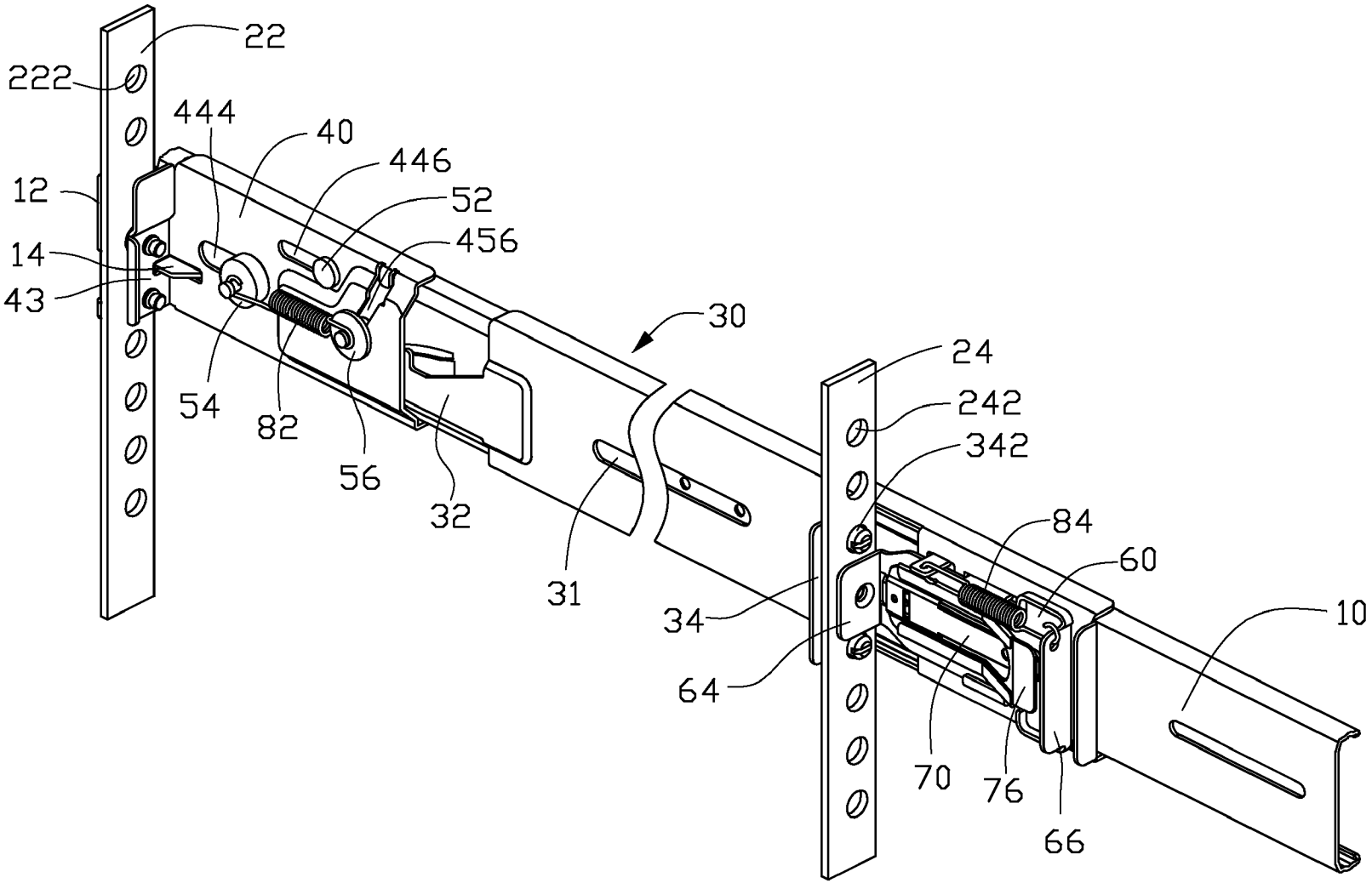
FIG. 1 is an isometric view of one embodiment of a fixing apparatus, shown with a first column, a second column, and a slide rail, the fixing apparatus including a first fixing module and a second fixing module.

Referring to FIG. 1, one embodiment of a fixing apparatus is configured to attach a slide rail 10 to a first column 22 and a second column 24. The first column 22 defines a plurality of through holes 222. The second column 24 defines a plurality of through holes 242. The fixing apparatus includes a release member 30, a first fixing member 40, a mounting member 52, a movable pulley 54, a slide member 56, a second fixing member 60, a resilient member 70, a first elastic member 82, and a second elastic member 84. The first fixing member 40, the mounting member 52, the movable pulley 54, the slide member 56, and the first elastic member 82 combine to form a first fixing module. The second fixing member 60, the resilient member 70, and the second elastic member 84 are combined to form a second fixing module.

Figure 2:
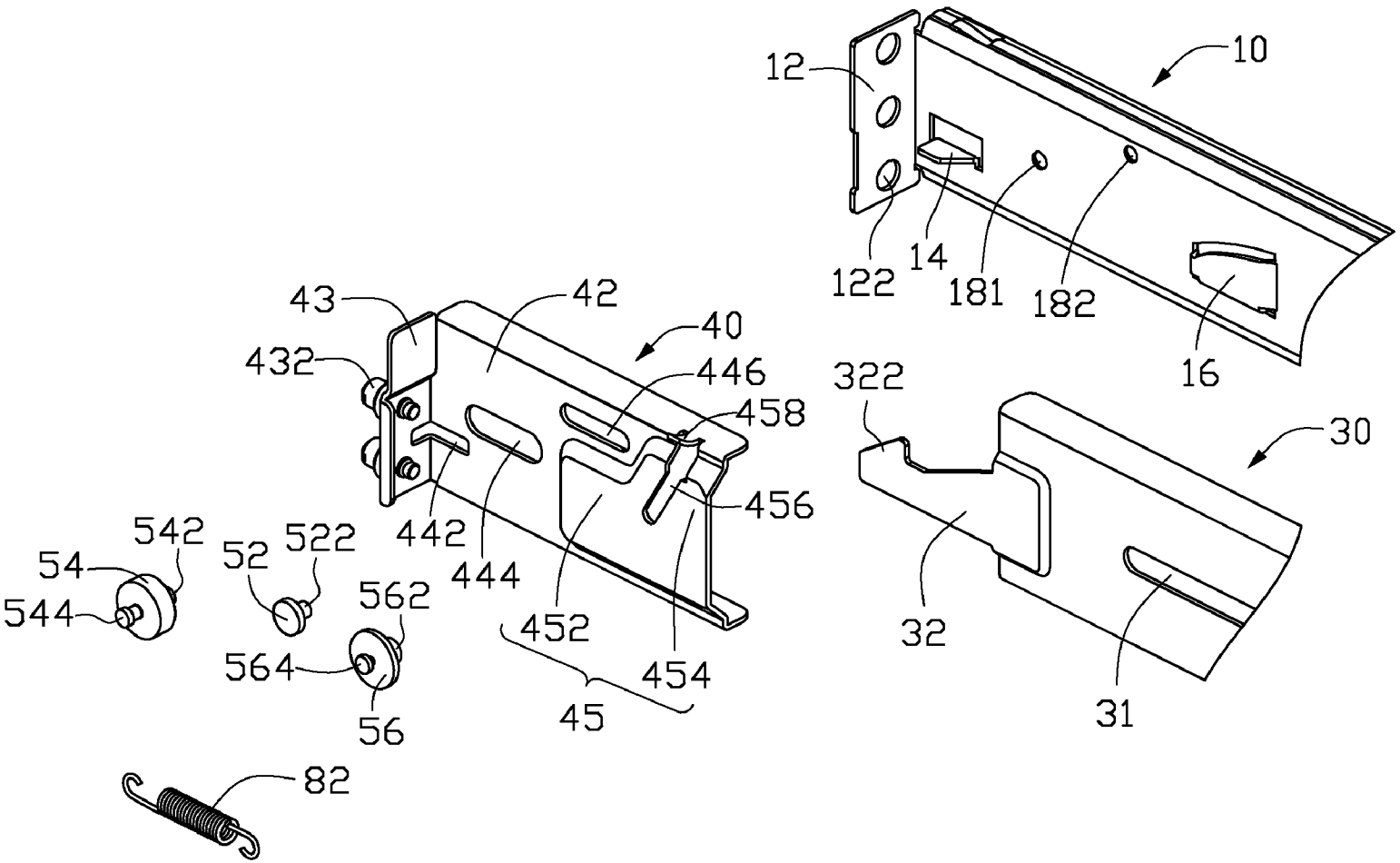
FIG. 2 is a partially exploded, isometric view of FIG. 1.

Referring to FIG. 2, the slide rail 10 includes a first end and a second end opposite to the first end. A flange 12 extends perpendicularly from the first end of the slide rail 10, and a plurality of through holes 122 are defined on the flange 12. A tab 14 extends from a lower part of the slide rail 10 neighboring the flange 12. A drive element 16 having an arc-shaped top extends from a middle portion of the slide rail 10. The slide rail 10 defines two fixing holes 181, 182 between the tab 14 and the drive element 16. The fixing hole 182 is positioned adjacent and above the fixing hole 181.

Figure 3:
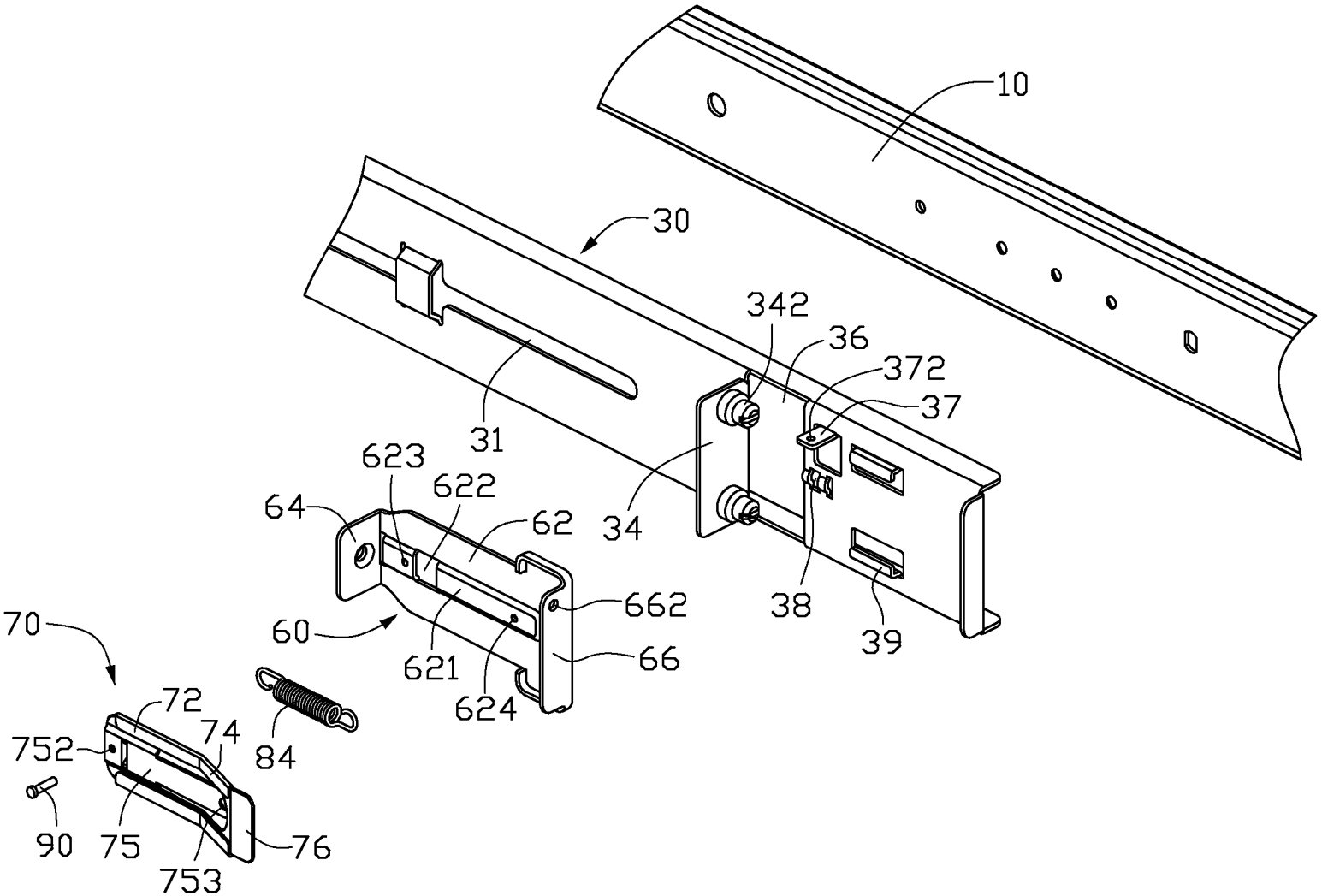
FIG. 3 is a partially exploded, isometric view of FIG. 1.

Referring to FIGS. 2 and 3, the release member 30 defines a slot 31 that extends horizontally. The release member 30 includes a first end and a second end opposite to the first end. A latching hook 32 extends from the first end of the release member 30. The latching hook 32 includes a resisting portion 322 positioned at a distal end. A mounting tab 34 perpendicularly extends from the release member 30 adjacent to the second end. Two parallel posts 342 extend from the mounting tab 34 towards the second end of the release member 30. The release member 30 defines an opening 36 adjacent to the mounting tab 34 and facing the posts 342. A securing tab 37 defining a fixing hole 372 extends from the release member 30 adjacent to an edge of the opening 36 opposite to the mounting tab 34. The release member 30 defines a locking slot 38 positioned under the securing tab 37. Two sliding portions 39 extend from the release member 30 between the securing tab 37 and the second end.

The first fixing member 40 includes a main body 42 and a blocking board 43 perpendicularly extending from a first end of the main body 42. Two parallel posts 432 perpendicularly extend from the blocking board 43, away from the main body 42. The main body 42 defines a first sliding groove 442, a second sliding groove 444, and a third sliding groove 446 along a horizontal direction. The first sliding groove 442 is positioned in a junction of the main body 42 and the blocking board 43. The second sliding groove 444 is positioned above the first sliding groove 442, and the third sliding groove 446 is positioned above the second sliding groove 444. An L-shaped protrusion 45 protrudes below the third sliding groove 446 from a second end of the main body 42 opposite to the first end. The protrusion 45 includes a horizontal portion 452 and a slanting portion 454. The slanting portion 454 slantingly extends upwards from a top end of the horizontal portion 452, adjacent to the second end of the main body 42. The slanting portion 454 defines a slanted slot 456. A size of a top end of the slanted slot 456 is greater than that of a bottom end of the slanted slot 456. A securing board 458 extends from the main body 42 adjacent to the top end of the slanted slot 456.

The mounting member 52 includes a discoid-shaped main part and a sliding portion 522 extends from an end surface of the main part.

The movable pulley 54 includes a discoid-shaped main part, a sliding portion 542 extending from an end surface of the main part, and a hook portion 544 extending from the opposite end of the main part.

Figure 5:
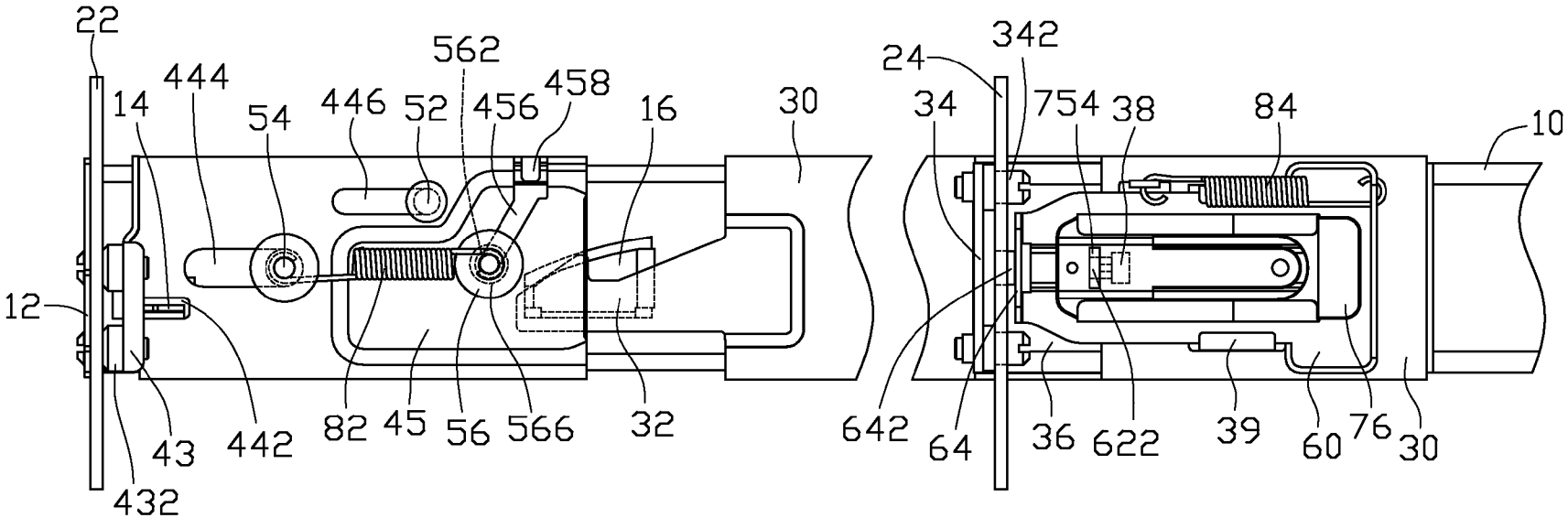
FIG. 5 is an elevational view of FIG. 1, showing the first and second fixing modules respectively fixed to the first and second columns.
Figure 6:
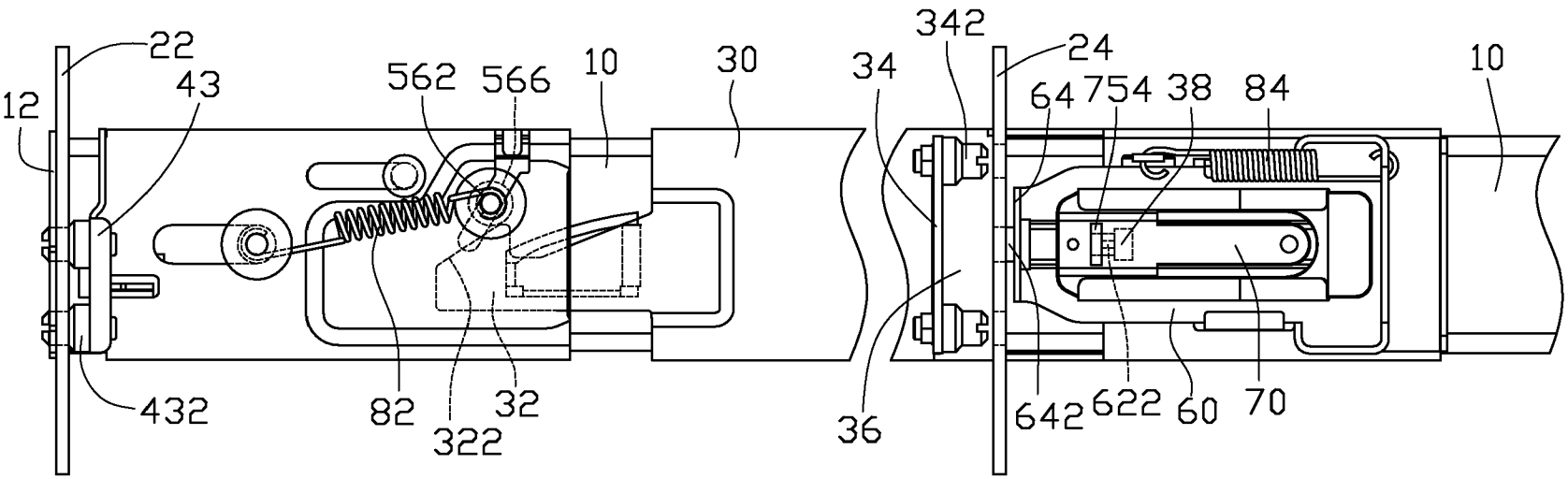
FIG. 6 to FIG. 8 are similar to FIG. 5, but showing a process of the first fixing module being disengaged from the first column.
Figure 7:
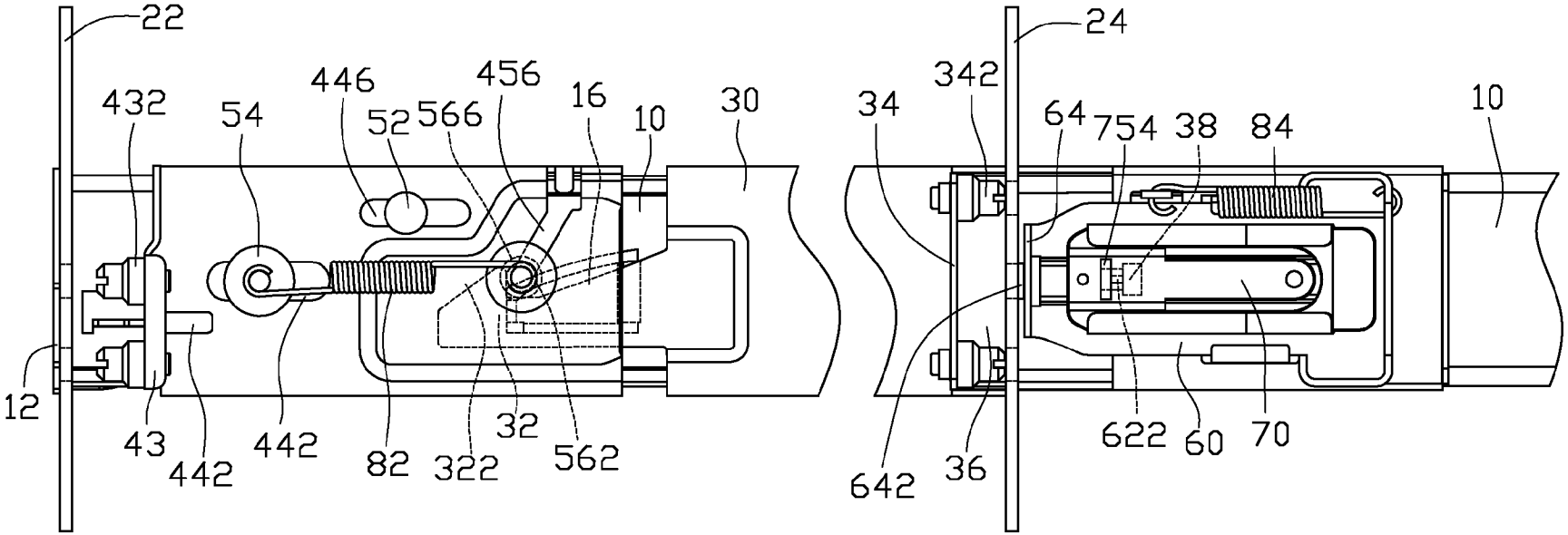
Figure 8:
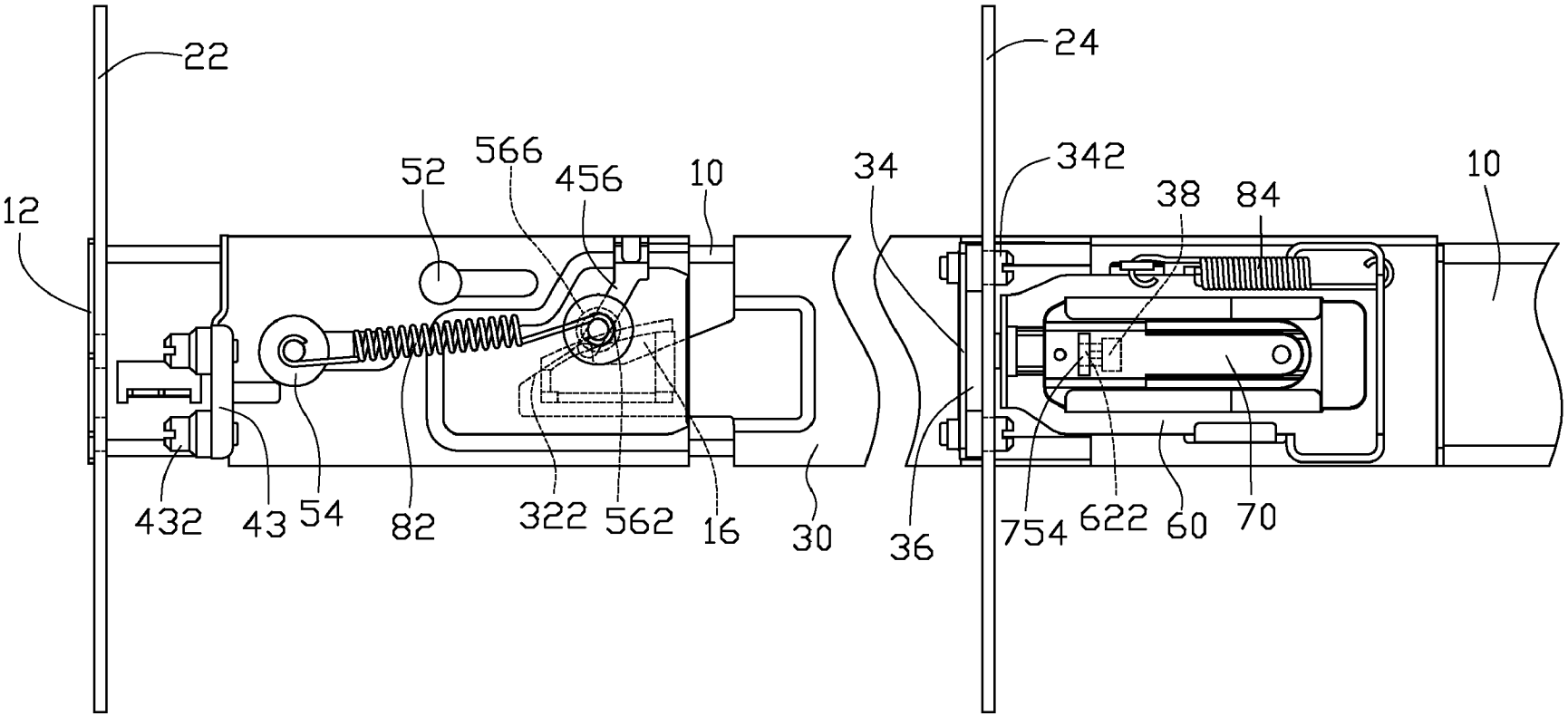
Figure 9:
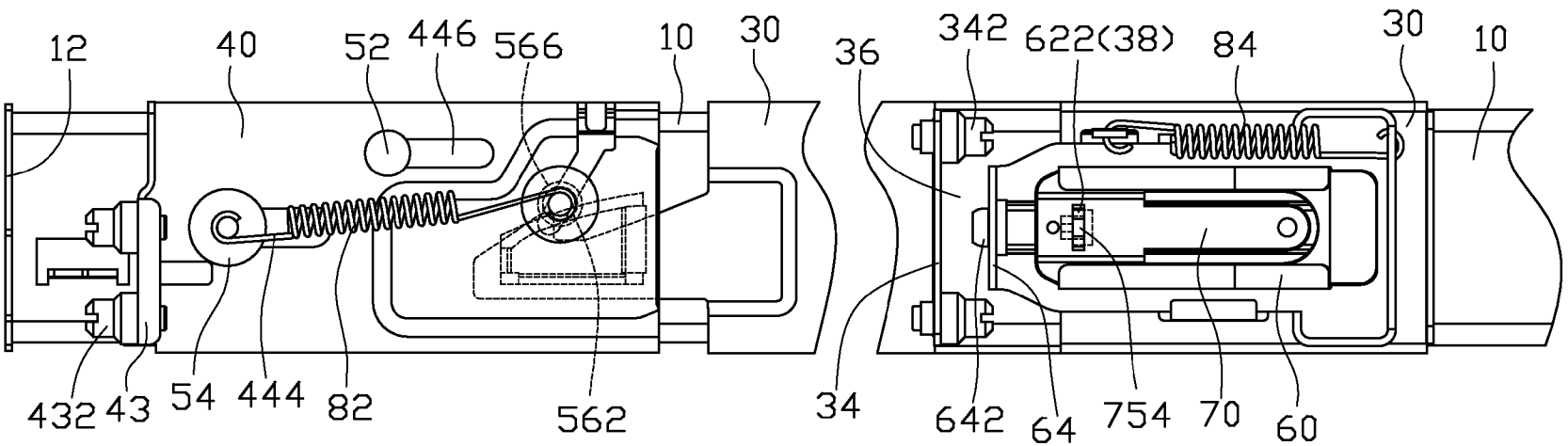
FIG. 9 is similar to FIG. 5, but showing the second fixing module being disengaged from the second column.

The slidable pulley 56 includes a discoid-shaped main part, a sliding portion 562 extending from an end surface of the main part, and a hook portion 564 extending from the opposite end surface of the main part. A stop portion 566 (shown in FIG. 5) extends from a distal end of the sliding portion 562, and has a greater diameter than a diameter of the sliding portion 562. The stop portion 566 can pass through the slanted slot 456 of the first fixing member 40 from the top end, and slide to the bottom end of the slanted slot 456. The stop portion 566 is engaged with but cannot be pulled out of the bottom end of the slanted slot 456.

Figure 4:
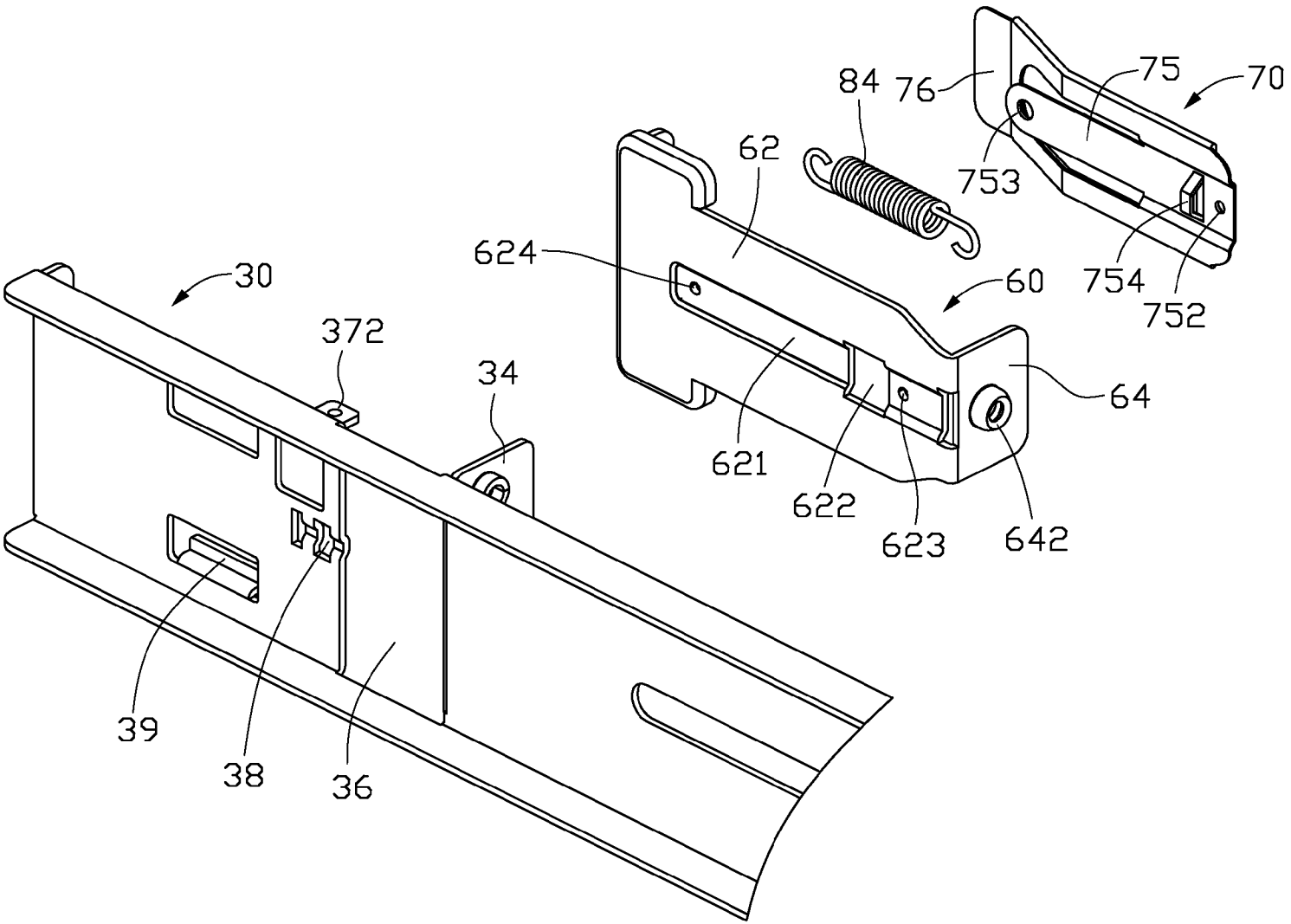
FIG. 4 is similar to FIG. 3, but viewed from another aspect.

Referring to FIGS. 3 and 4, the second fixing member 60 includes a main body 62, a fixing tab 64 perpendicularly extending from a first end of the main body 62, and a fixing board 66 perpendicularly extending from a second end of the main body 62. The fixing board 66 defines a fixing hole 662. A post 642 extends from the fixing tab 64, away from the fixing board 66. A protrusion 621 longitudinally extends from a middle portion of the main body 62. The protrusion 621 defines a receiving hole 622 adjacent to the first end, and two fixing holes 623, 624 positioned at opposite sides of the corresponding receiving hole 622.

The resilient member 70 includes a main body 72, a resilient portion 74 slantingly extending from an end of the main body 72, and an operating portion 76 horizontally extending from a distal end of the resilient portion 74. The main body 72 defines a U-shaped slot in a junction of the main body 72 and the resilient portion 74. A fixing portion 75 is surrounded by the U-shaped slot. The main body 72 defines a sliding hole 752 away from the operating portion 76. A clasp portion 754 extends perpendicularly from the main body 72 adjacent to the sliding hole 752. A through hole 753 is defined in an end of the fixing portion 75 away from the sliding hole 752.

Referring to FIG. 1 again, the first and second elastic members 82, 84 may be helical springs.

Referring to FIGS. 1 to 5, in assembly, a plurality of screws (not shown) may be passed through the slot 31 of the release member 30, and screwed into the slide rail 10. Accordingly, the release member 30 is fixed to the slide rail 10. The latching hook 32 is aligned to the drive element 16 of the slide rail 10.

The first fixing member 40 is attached to the slide rail 10 between the first end and the second end of the slide rail 10, with the tab 14 of the slide rail 10 passing through the first sliding groove 442 of the first fixing member 40. The first fixing member 40 is moved towards the first end of the slide rail 10, until the posts 432 of the first fixing member 40 are engaged in the corresponding through holes 122. The latching hook 32 is received between the protrusion 45 and the slide rail 10.

The sliding portion 522 of the mounting member 52 is slidably passed through the third sliding groove 446, and fixed to the fixing hole 182 of the slide rail 10. The sliding portion 542 of the movable pulley 54 is slidably passed through the second sliding groove 444 of the first fixing member 40, and fixed to the fixing hole 181 of the slide rail 10. The stop portion 566 of the slidable pulley 56 is passed through the top end of the slanted slot 456, so that the sliding portion 562 is slidably received in the slanted slot 456. The sliding portion 562 of the slidable pulley 56 is moved to the bottom end of the slanted slot 456. The securing board 458 is bent and extended into the top end of the slot 456. The securing board 458 and the stop portion 566 of the slidable pulley 56 are configured to prevent the slidable pulley 56 from disengaging out of the slot 456. One end of the first elastic member 82 is fixed to the hook portion 544, and the other end of the first elastic member 82 is fixed to the hook portion 564. The first elastic member 82 is configured to drive the blocking board 43 to close to the flange 12, and drive the posts 432 to remain in and engage in the corresponding through holes 122.

A guiding element 90 (shown in FIG. 3) includes a pole and a distal end of the pole forming a threaded portion. The guiding element 90 is movably passed through the sliding hole 752 of the resilient member 70. The threaded portion of the guiding element 90 is screwed into the fixing hole 623, and the resilient member 70 can move along the pole of the guiding element 90. A screw (not shown) may be passed through the through hole 753 and engaged in the fixing hole 624 to fix the fixing portion 75 to the second fixing member 60. The clasp portion 754 of the resilient member 70 is received in the receiving hole 662 of the second fixing member 60.

The main body 62 is attached between the sliding portions 39. The second fixing member 60 is moved towards the mounting tab 34 of the release member 30, until the clasp portion 754 is received in the opening 36 of the resilient member 30. One end of the second elastic member 84 is fixed to the fixing hole 372, and the other end of the second elastic member 84 is fixed to the fixing hole 662.

To fix the second end of the slide rail 10 to the second column 24, the operating portion 76 is pressed, and the end opposite to the operating portion 76 of the main body 72 is lifted away from the second fixing member 60. As a result, the clasp portion 754 is disengaged from the opening 36 and the receiving hole 622. When the second fixing member 60 is pulled away from the mounting tab 34, the distance between the mounting tab 34 and the fixing tab 64 becomes large enough for receiving the second column 24. The second elastic member 84 is stretched. When the posts 342 are aligned to the corresponding through holes 242 of the second column 24, the second fixing member 60 is released. The second elastic member 84 constricts and pulls the second fixing member 60 towards the mounting tab 34. The post 642 becomes engaged with a corresponding through hole 242 of the second column 24. Accordingly, the second end of the slide rail 10 becomes fixed to the second column 24.

To fix the first end of the slide rail 10 to the first column 24, the first fixing member 40 is pulled towards the mounting tab 34 of the release member 30. The distance between the flange 12 of the slide rail 10 and the blocking board 43 of the first fixing member 40 becomes large enough for receiving the first column 22. The first elastic member 82 is stretched. The first column 22 is positioned between the brackets such that the through holes 222 of the first column 22 are aligned with the through holes 122 of the flange 12. The first fixing member 40 is released. The first elastic member 82 pulls the first fixing member 40 against the first column 22, thereby clamping the first column 22 between the flange 12 and the blocking board 43. Consequently, the posts 432 protrude through the corresponding through holes 222 of the first column 22 and the corresponding through holes 122 of the flange 12. As a result, the first column 22 is further clamped between the brackets via the posts 432.

Referring also to FIGS. 6 through 9, to detach the first end of slide rail 10 from the first and second columns 22, 24, the release member 30 is slid towards the first column 22. As a result, the sliding portion 562 of the slidable pulley 56 becomes driven by the resisting portion 322 of the latching hook 32 and slides upward in the slanted slot 456, stretching the first elastic member 82. The release member 30 is slid until the latching hook 32 hooks onto the sliding portion 562, and until the sliding portion 562 slides over the resisting portion 322. Consequently, the first elastic member 82 reacts between the movable pulley 54 and the latching hook 32 via the sliding portion 562.

The release member 30 is pulled to move towards the second columns 24. Since the latching hook 32 is now hooked onto the sliding portion 562, when the release member 30 is moved towards the second columns 24, it also pulls the first fixing member 40 in the same direction because, when the release member 30 is pulled, the latching hook 32 pulls on the sliding portion 562. The first elastic member 82 becomes stretched, and the blocking board 43 is moved away from the first column 22. The posts 432 disengage from the through holes 122 of the flange 12 of the slide rail 10 and the through holes 222 of the first column 22. The first end of the slide rail 10 can then be removed from the first column 22.

The release member 30 is moved towards the second column 24, until the latching hook 32 is aligned with the drive element 16 of the slide rail 10. The sliding portion 562 of the slidable pulley 56 is moved onto the drive element 16, and the sliding portion 562 is moved upwards in the slanted slot 456 of the first fixing member 40. When the sliding portion 562 is moved to the top of the slanted slot 456, the sliding portion 562 is across the top portion of the resisting portion 322 of the release member 30 to disengage from the resisting portion 322. The sliding portion 562 slides downward in the resisting portion 322 because of the first elastic member 82. The release member 30 is released, and the first elastic member 82 is restored for biasing the first fixing portion 40 to move back.

When the release member 30 is slid along the slide rail 10, the post 642 of the second fixing member 60 and the posts 342 of the release member 30 are slid in the corresponding holes 222 of the second column 24.

To detach the second end of the slide rail 10 from the first and second columns 24, the operating portion 76 of the resilient member 70 is pressed, and the end opposite to the operating portion 76 of the main body 72 is lifted away from the second fixing member 60. The clasp portion 754 is disengaged from the opening 36 of the release member 30 and the receiving hole 622 of the second fixing member 60. The second fixing member 60 is pulled away from the mounting tab 34 until the clasp portion 754 is engaged in the locking slot 38. The post 642 of the second fixing member 60 is disengaged from the corresponding through hole 242 of the second column 24. The release member 30 is pushed away from the second end of the slide rail 10, and the posts 342 of the release member 30 are disengaged from the corresponding through holes 242 of the second column 24. Thus, the second end of the slide rail 10 can be removed from the second column 24.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment.

What is claimed is:

1. A fixing apparatus configured to engage with a first column and a second column, the fixing apparatus comprising:

a slide rail having a flange extending from an end of the slide rail;

a first fixing member attached to and slid along the slide rail facing the flange, wherein a blocking board extends from the first fixing member, a first post extending from the blocking board is configured to be engaged with the first column;

a release member defining an opening therein, wherein a mounting tab extends from the release member, a second post extends from the mounting tab configured to be engaged with the second column, a latching hook extending from the release member away from the mounting tab configured to drive the first fixing member towards the flange;

a second fixing member attached to the release member and slid along the slide rail opposite to the first fixing member, wherein the second fixing member comprises a fixing tab, a third post extends from the fixing tab configured to be engaged with the second column;

a resilient latching member mounted to the second fixing member, the resilient member having a clasp portion extending from the resilient member;

wherein the blocking board and the flange are cooperatively configured to sandwich the first column; the fixing tab and the mounting tab of the release member are configured to sandwich the second column; the clasp portion is engaged in the opening of the release member to fix the slide rail to the second column.

2. The fixing apparatus of claim 1, wherein the release member defines a sliding groove therein; the first fixing member comprises a protrusion configured to receive the latching hook of the release member, the protrusion defines a slanted slot therein; a slidable pulley is passed through the slanted slot and slid along the slot; a movable pulley is slidably passed through the sliding groove, and fixed to the slide rail; two opposite ends of a first elastic member are fixed to the slidable pulley and the movable pulley; the first elastic member is pulling the blocking board of the first fixing member to close to the flange of the slide rail.

3. The fixing apparatus of claim 2, wherein the slidable pulley comprises a sliding portion; the latching hook comprises a resisting portion; the resisting portion resists against the sliding portion and drives the sliding portion of the slidable pulley to move and engage with the latching hook.

4. The fixing apparatus of claim 3, wherein a drive element having an arc-shaped top extends from the slide rail; the sliding portion of the slidable pulley is configured to slide downwards along the drive element, and disengaging from the latching hook.

5. The fixing apparatus of claim 1, wherein the resilient member comprises a main body, a resilient portion, and an operating portion; the resilient portion slantingly extends from an end of the main body, and the operating portion horizontally extends from a distal end of the resilient portion; the main body defines a U-shaped slot in a junction of the main body and the resilient portion, a fixing portion is formed at an inner part of the U-shaped slot, and the clasp portion extends perpendicularly from the main body; when the operating portion is pressed, one end of the resilient member is lifted away from the second fixing member with the clasp portion, the clasp portion is disengaged from the opening.

6. The fixing apparatus of claim 5, wherein the main body defines a sliding hole therein away from the operating portion, the fixing portion defines a through hole therein away from the sliding hole; the second fixing member defines a receiving hole therein for receiving the clasp portion, and a fixing hole positioned beside the receiving hole; when a guiding element is passed through the sliding hole and fixed to the fixing hole, the second fixing member is fixed to the main body.

7. The fixing apparatus of claim 1, wherein the resilient member defines a locking slot therein adjacent to the opening; the clasp portion is clamped in the locking slot.

8. The fixing apparatus of claim 1, wherein two sliding portions extend from the release member; two of the longitudinal ends of the second fixing member resists against the two sliding portions; a securing tab defining a first fixing hole extends from the release member adjacent to one of the sliding portion; a fixing board parallel to the fixing tab defining a second fixing hole perpendicularly extends from the second fixing member; a first of the two opposite ends of a second elastic member is fixed to the first fixing hole and a second of the two opposite ends of a second elastic member is fixed to the second fixing hole, the second elastic member pulls the fixing tab to close the mounting tab.

9. An assembly comprising:

a slide rail comprising a first end and a second end opposite to the first end, the slide rail having a flange extending from the first end, the flange defines a plurality of fixing holes therein;

a first column and a second column each defining a plurality of through holes therein; and a fixing apparatus comprising:

a first fixing member attached to and slid along the slide rail facing the flange, wherein a blocking board extends from the first fixing member, a first post extending from the blocking board is configured to be engaged with the first column;

a release member defining an opening therein, wherein a mounting tab extends from the release member, a second post extends from the mounting tab configured to be engaged with the second column, a latching hook extending from the release member away from the mounting tab configured to drive the first fixing member towards the flange;

a second fixing member attached to and slid along the slide rail opposite to the first fixing member, wherein the second fixing member comprises a fixing tab, a third post extends from the fixing tab configured to be engaged with the second column;

a resilient member mounted to the second fixing member, the resilient member having a clasp portion extending from the resilient member;

wherein the blocking board and the flange are cooperatively configured to sandwich the first column; the fixing tab and the mounting tab of the release member are configured to sandwich the second column; the clasp portion is engaged in the opening to fix the slide rail to the second column.

10. The assembly of claim 9, further comprising a resilient member mounted to the second fixing member, the resilient member comprises a main body, a resilient portion, and an operating portion; the resilient portion slantingly extending from an end of the main body, and the operating portion horizontally extending from a distal end of the resilient portion; the main body defines a U-shaped slot in a junction of the main body and the resilient portion, a fixing portion is formed at an inner part of the U-shaped slot, and the clasp portion extends perpendicularly from the main body; when the operating portion is pressed, one end of the resilient member is lifted away from the second fixing member with the clasp portion, the clasp portion is disengaged from the opening.

11. The assembly of claim 10, wherein the main body defines a sliding hole therein away from the operating portion, the fixing portion defines a through hole therein away from the sliding hole; the second fixing member defines a receiving hole therein for receiving the clasp portion, and a fixing hole positioned beside the receiving hole; when a guiding element is passed through the sliding hole and fixed to the fixing hole, the second fixing member is fixed to the main body.

12. The assembly of claim 10, wherein the resilient member defines a locking slot therein adjacent to the opening; the clasp portion is clamped in the locking slot.

13. The assembly of claim 9, wherein two sliding portions extend from the release member; two of the longitudinal ends of the second fixing member resists against the two sliding portions; a securing tab defining a first fixing hole extends from the release member adjacent to one of the sliding portion; a fixing board parallel to the fixing tab defining a second fixing hole perpendicularly extends from the second fixing member; a first of the two opposite ends of a second elastic member is fixed to the first fixing hole and a second of the two opposite ends of a second elastic member is fixed to the second fixing hole, the second elastic member pulls the fixing tab to close the mounting tab.

14. The assembly of claim 9, wherein the release member defines a sliding groove therein; the first fixing member comprises a protrusion configured to receive the latching hook of the release member, the protrusion defines a slanted slot therein; a slidable pulley is passed through the slanted slot and slid along the slot; a movable pulley is slidably passed through the sliding groove, and fixed to the slide rail; two opposite ends of a first elastic member are fixed to the slidable pulley and the movable pulley; the first elastic member is pulling the blocking board of the first fixing member to close to the flange of the slide rail.

15. The assembly of claim 14, wherein the slidable pulley comprises a sliding portion; the latching hook comprises a resisting portion; the resisting portion resists against the sliding portion and drives the sliding portion of the slidable pulley to move and engage with the latching hook.

16. The assembly of claim 15, wherein a drive element having an arc-shaped top extends from the slide rail; the sliding portion of the slidable pulley is configured to slide downwards along the drive element, and disengaging from the latching hook.

* * * * *